US010505295B2

(12) United States Patent
Moser

(10) Patent No.: US 10,505,295 B2
(45) Date of Patent: Dec. 10, 2019

(54) TERMINAL

(71) Applicant: Electro Terminal GmbH & Co KG, Innsbruck (AT)

(72) Inventor: Peter Moser, Stans (AT)

(73) Assignee: Electro Terminal GmbH & Co KG, Innsbruck (AT)

( * ) Notice: Subject to any disclaimer, the term of this patent is extended or adjusted under 35 U.S.C. 154(b) by 0 days.

(21) Appl. No.: 15/976,004

(22) Filed: May 10, 2018

(65) Prior Publication Data

US 2018/0331438 A1 Nov. 15, 2018

(30) Foreign Application Priority Data

May 12, 2017 (DE) ..... 20 2017 102 853 U
Dec. 21, 2017 (DE) ..... 20 2017 107 800 U

(51) Int. Cl.

| | |
|---|---|
| ***H01R 9/24*** | (2006.01) |
| ***H01R 4/48*** | (2006.01) |
| ***H01R 13/627*** | (2006.01) |
| ***H01R 13/629*** | (2006.01) |
| ***H01R 13/639*** | (2006.01) |

(52) U.S. Cl.

CPC ..... *H01R 9/2416* (2013.01); *H01R 4/48* (2013.01); *H01R 13/6275* (2013.01); *H01R 13/62905* (2013.01); *H01R 13/639* (2013.01)

(58) Field of Classification Search

CPC ..... H01R 4/4818; H01R 4/48; H01R 4/4836; H01R 4/4845
USPC ..... 439/441, 834, 835
See application file for complete search history.

(56) References Cited

U.S. PATENT DOCUMENTS

| | | | | |
|---|---|---|---|---|
| 8,794,994 | B2 * | 8/2014 | Kollmann | H01R 4/4836 439/441 |
| 9,478,874 | B2 * | 10/2016 | Stolze | H01R 4/4836 |
| 9,525,217 | B2 | 12/2016 | Kollmann et al. | |
| 9,525,219 | B2 * | 12/2016 | Kollmann | H01R 4/4836 |
| 9,543,700 | B2 * | 1/2017 | Kollmann | H01R 4/4836 |
| 9,761,964 | B2 * | 9/2017 | Meyer | H01R 4/4836 |

FOREIGN PATENT DOCUMENTS

| | | |
|---|---|---|
| DE | 10237701 A1 | 2/2004 |
| EP | 1956684 A2 | 8/2008 |

* cited by examiner

*Primary Examiner* — Hien D Vu
(74) *Attorney, Agent, or Firm* — The H.T. Than Law Group

(57) ABSTRACT

A terminal for electrically connecting at least one conductor comprises an insulating material housing, a contact body with a contact frame and a contact spring, and an operating element. The operating element has a bearing region for rotatably mounting the operating element in the insulating material housing about a rotation axis, and at least one operating structure, which is at a radial distance from the bearing region and extends in the direction of the rotation axis, for moving the clamping limb between the conductor clamping position and the conductor release position in the event of a rotational movement of the operating element about its rotation axis. The insulating material housing has a supporting region which axially extends between the rotation axis and the operating structure to support the operating structure on the supporting region at least in the conductor release position.

24 Claims, 16 Drawing Sheets

Figure 1A:
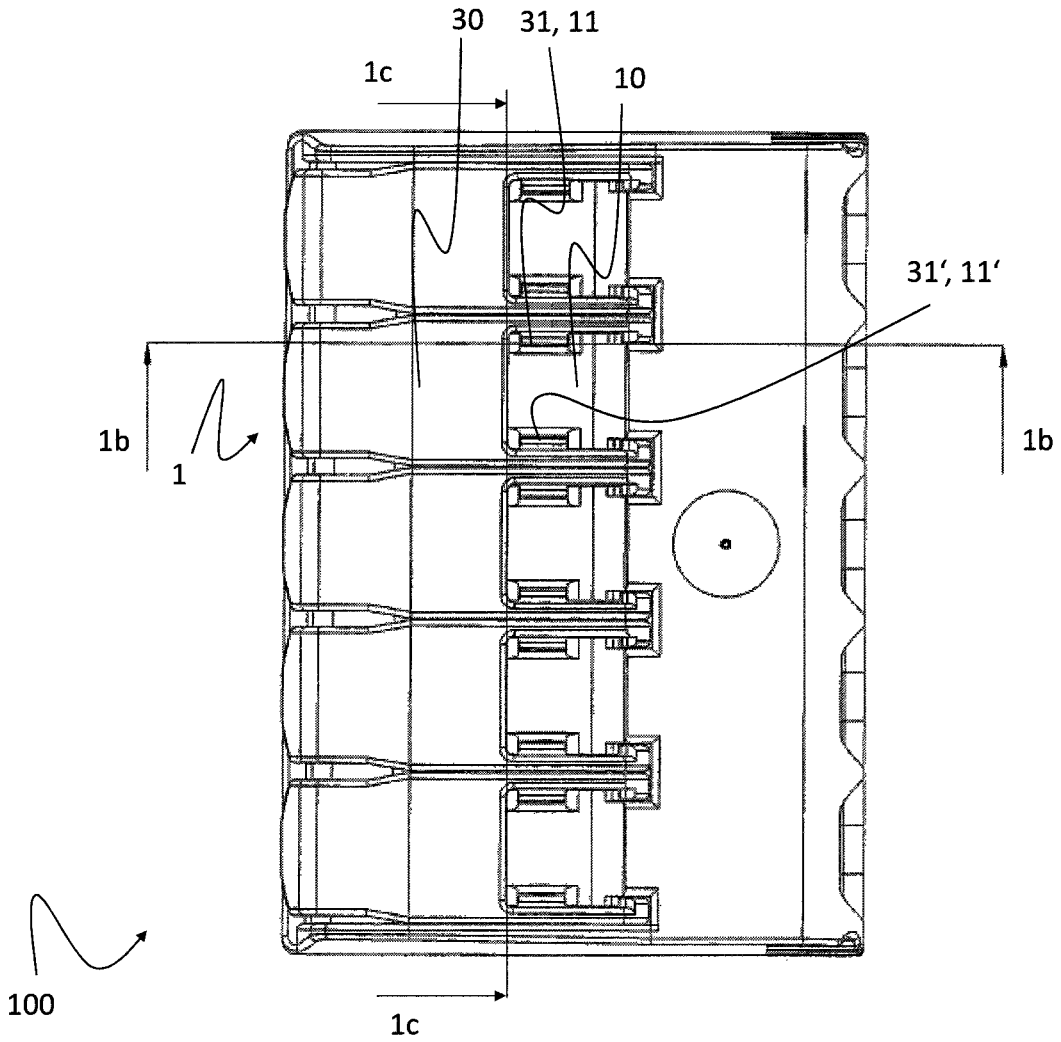

Fig. 9b
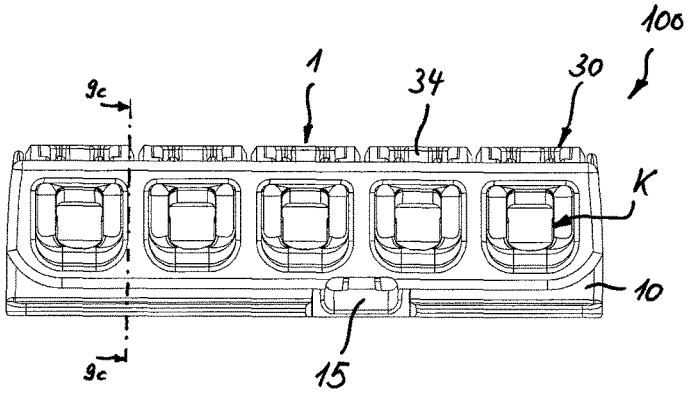
Fig. 9c
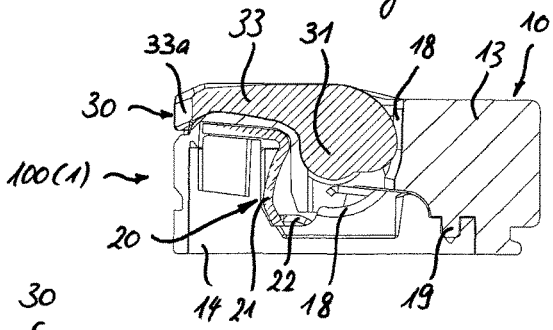
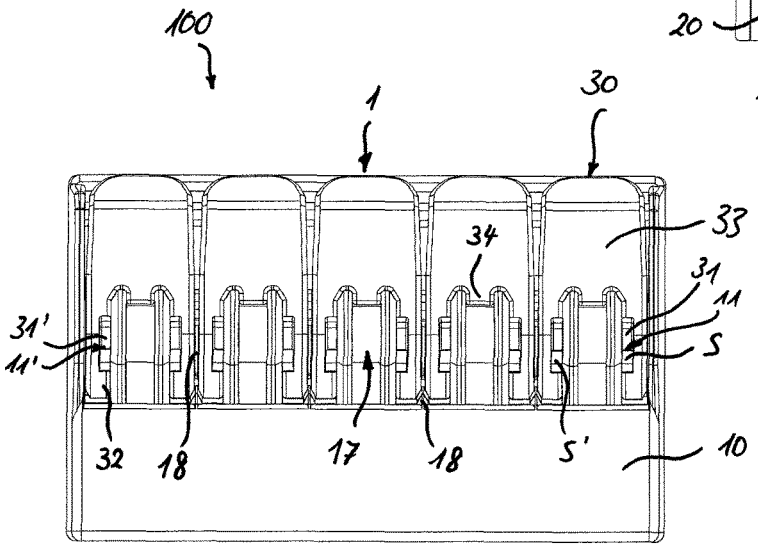
Fig. 9d

TERMINAL

The present invention relates to a terminal, and in particular to a connection or connecting terminal for electrically connecting at least one electrical conductor.

A terminal of the kind mentioned in the introductory part is known, for example, from WO 2014/124958 A1. The terminal described in said document has an operating element which can be moved from a closed position, in which a clamping point for clamping on an electrical conductor is closed, to an open position, in which the clamping point for clamping on an electrical conductor is open. Here, the operating element is rotatably mounted by means of a bearing region in a bearing contour of an insulating material housing, which bearing contour is in the form of part of a circle, wherein an operating contour which is formed in the bearing region is in engagement with a clamping limb in order to open and, respectively, to close the clamping point for clamping on. However, the abovementioned terminal requires a relatively large insulating material housing for moving the clamping limb and, respectively, for applying the force for moving the clamping limb by means of the operating element. Furthermore, the terminal, that is to say, in particular, the operating element with its operating contour, can produce rather low forces on the clamping limb, and this can be disadvantageous, in particular, in respect of relatively large clamping forces as occur, for example, in lines with a relatively large cross section. This in turn has a disadvantageous effect on the operation of the terminal, in particular when lines with a comparatively large cross section are intended to be used. Similar terminals are known from DE 102 37 701 A1, WO 2014/124959 A1, EP 1 956 684 A2 and WO 2013/087619 A1.

One object of the present invention is therefore to provide a terminal of the kind mentioned in the introductory part which is of compact design and can be operated in a simple manner.

This object is achieved by the subject matter of the independent claim. The dependent claims develop the central concept of the present invention in a particularly advantageous manner.

The invention relates to a terminal, in particular a connection or connecting terminal, for electrically connecting at least one electrical conductor. The terminal has an insulating material housing and a contact body, which is accommodated in the insulating material housing, comprising a contact frame and a contact spring with a contact limb for providing a conductor clamping point for electrically connecting the conductor together with the contact frame. The clamping limb of the contact spring can be moved between a conductor clamping position and a conductor release position.

The "conductor clamping position" is understood to mean, in particular, a position in which a clamping force is transmitted from the contact spring to the contact frame in order to clamp, in particular, an electrical conductor between the contact frame and the contact spring. The "conductor release position" is understood to mean, in particular, a position in which the contact spring does not exert any clamping force onto the contact frame or an electrical conductor, so that an electrical conductor can be removed from the terminal or can be inserted into the terminal in order to be subsequently clamped.

The terminal further has an operating element in order to move the clamping limb between the conductor clamping position and the conductor release position. The operating element has a bearing region for rotatably mounting the operating element in the insulating material housing about a rotation axis, and at least one operating structure, which is at a radial distance from the bearing region and extends in the direction of the rotation axis, for moving the clamping limb between the conductor clamping position and the conductor release position in the event of a rotational movement of the operating element about its rotation axis. The insulating material housing further has a supporting region which axially extends between the rotation axis and the operating structure in such a way that the operating structure is supported on the supporting region at least in the conductor release position.

In other words, a particularly advantageous lever ratio is formed by radially spacing apart the operating structure, which is in the form of a projection in particular, from the bearing region, so that relatively large forces can be transmitted to the clamping limb by means of the operating element. At the same time, a particularly advantageous flow of force between the operating element and insulating material housing is achieved by the supporting region of the insulating material housing which is provided with respect to the bearing region and the operating structure, this being particularly beneficial for the dimensioning of the insulating material housing. The insulating material housing can therefore be designed to be more compact, that is to say in particular flatter. The interaction between the operating structure and the supporting region therefore creates, in particular, relatively large forces for opening the conductor clamping point or for moving an, in particular stiff, clamping limb together with a compact design of the terminal. The terminal can therefore provide for particularly simple operation for opening and closing the conductor clamping point even in applications in which relatively high clamping forces are required (for example terminals for relatively thick lines, such as with a cross section of 4 $mm^2$ for example).

The operating structure is preferably supported on the supporting region in the conductor release position in such a way that the operating element is captively held at least in the conductor release position. The operating structure and the supporting region therefore provide effective protection against loss for the operating element, so that, in particular when a conductor is removed from and inserted into the terminal, the operating element does not fall out given different orientations of the terminal.

Furthermore, it can be provided that the operating structure is formed in such a way, and the supporting region extends between the rotation axis and the operating structure in such a way, that the operating structure is supported on the supporting region and preferably engages behind the supporting region in the conductor clamping position, so that the operating element is captively held in the conductor clamping position. Effective protection against loss by the supporting region and the operating structure for the operating element is therefore provided when the conductor is clamped in the terminal, that is to say in the conductor clamping position. The operating structure can be formed in such a way that the operating structure inhibits a rotational movement of the operating element in the conductor release position by contact with the clamping limb, wherein the rotational movement is at least one rotational movement for moving the clamping limb from the conductor clamping position to the conductor release position. In other words, a self-locking which is effected by the operating structure and the clamping limb in the conductor clamping position provides a rotation stop for the operating element, without providing a structural stop, such as a projection for example, in the insulating material housing and/or on the operating element. Therefore, the manufacturing expenditure on the terminal in particular can be reduced in this way.

The operating structure preferably has a side which is directed toward the bearing region, wherein a first part of the side, which part is particularly preferably in the form of a segment of a circle, is at a constant radial distance from the bearing region, in particular from the supporting region, and wherein a second part of the side, which second part adjoins the first part, is at an increasing radial distance from the bearing region, in particular from the supporting region. Therefore, the first part can be formed, in particular, by a segment of a circle, the center point of which is coaxial to the rotation axis of the bearing region. Therefore, "at a constant radial distance" is understood to mean, in particular, that substantially all points on the first part are at the same distance from the rotation axis. The second part can extend with respect to the first part, for example, in such a way that as the extent increases, the (radial) distance from the bearing region increases at the same time. Therefore, "at an increasing radial distance" is understood to mean, in particular, in such a way that the distance from the rotation axis increases at the same time as the distance of a point which is provided on the second part increases. A configuration of the first and of the second part of this kind is advantageous for the terminal in many respects. Firstly—since the first part extends to a relatively short extent in the direction of rotation—the friction between the supporting region and the operating structure which is guided or supported by means of the supporting region is kept low, this being beneficial, in particular, in terms of the wear and the operation of the terminal. Secondly, owing to the second part which extends away from the bearing region, a particularly high force can be exerted onto the clamping limb, said force increasing or decreasing as the rotation angle of the operating element increases from the conductor clamping position to the conductor release position and, respectively, from the conductor release position to the conductor clamping position.

It can further be advantageous when the first part is supported on the supporting region both in the conductor clamping position and also in the conductor release position, wherein the second part is preferably at a distance from the supporting region both in the conductor clamping position and also in the conductor release position. In particular, the abovementioned effect of simple operation and, respectively, of low wear and also favorable application of force is increased as a result.

In a particularly preferred embodiment, the first part is provided at an angle in the range of from 15° to 40°, preferably of from 20° to 35°, particularly preferably of from 22° to 26°, with respect to the rotation axis. As an alternative or in addition, the second part is provided at an angle in the range of from 20° to 40°, preferably of from 25° to 40°, particularly preferably of from 30° to 35°, with respect to the rotation axis. Here, the vertex of the angle is situated on the rotation axis, wherein the half-lines of the angle, between which the respective part extends, are perpendicular to the rotation axis, and wherein one of the respective half-lines is preferably substantially parallel to the conductor insertion direction in the conductor clamping position.

The operating element can further have an operating lever, wherein the operating structure and the operating lever are provided on substantially opposite sides with respect to the rotation axis and/or the bearing region, that is to say the bearing region is provided between the operating lever and the operating structure as seen in a plan view of the operating element. The operating element can be operated in a particularly simple manner by means of the operating lever and the resulting lever ratios with the bearing region and the operating structure.

The operating element can have a guide section which projects radially toward the rotation axis. Said guide section can be accommodated in a sliding manner in a radial guide groove of the insulating material housing, which radial guide groove runs at least partially around the rotation axis, in order to axially guide the operating lever on both sides in the event of the rotational movement of said operating lever about the rotation axis. To this end, the guide section can preferably be accommodated in a sliding manner in a bearing region of the insulating material housing which interacts with the bearing region for rotatably mounting the operating element. The guide section can extends away, preferably extend radially away, from the operating lever, or extend (radially) away from the operating lever in the center of the operating lever with respect to the axial direction of the rotation axis. Owing to the sliding arrangement of the guide section in the radial guide groove, secure lateral, that is to say axial, guidance is provided during the entire pivoting movement of the operating element. Consequently, the operating elements can be inserted, that is to say fitted, and operated functionally independently of adjacent components, such as adjacent operating elements for example. Therefore, unintentional interaction between, for example, adjacent operating elements (for example tilting or catching) can be reliably prevented. This (central) guidance of each operating element therefore allows each operating element to be supported and guided on its own; independently of the presence of or the relative position of further operating elements.

The operating element can further have two operating structures, wherein the operating structures are at an axial distance from one another and preferably extend toward one another, that is to say are preferably situated diametrically at a distance from one another. That is to say, the operating structures can be configured and provided, in particular, in an identical manner on the operating element. As a result, it is possible, in particular, that—as seen in the conductor insertion direction—the operating structures act on opposite ends of the clamping limb. Firstly, this is advantageous for improved accessibility to the clamping point for a conductor. Secondly, the balanced distribution of the forces of the operating structures on the clamping limb result in reduced loading in the clamping limb, that is to say, in particular, in respect of torsion of the clamping limb, owing to operation.

A supporting face of the supporting region, on which the operating structure is supported, can be at a constant radial distance from the rotation axis. The supporting face is preferably designed in the form of a segment of a circle, particularly preferably in a manner corresponding to the first part of the operating structure, as seen in the axial direction. Constantly advantageous guidance and, respectively, support of the operating structure is ensured in this way.

Furthermore, the supporting region can be part of a guide groove, which is formed in the insulating material housing, for guiding the operating structure. The supporting region can therefore be formed or produced in a simple manner by forming a groove, for example by means of injection-molding. In addition, the groove or the guide groove at the same time produce improved guide properties for the operating structure or the operating element.

The insulating material housing can have a first housing part and a second housing part which is connected to the first housing part, wherein the first housing part is provided for rotatably mounting the operating element and has the supporting section, and wherein the contact body is accommodated between the first housing part and the second housing part. In particular, simple mounting of the contact body in the insulating material housing can be achieved in this way.

The insulating material housing can further have a rotation-prevention section for the operating element, which rotation-prevention section is in engagement with or can be brought into engagement with the operating element in the conductor clamping position, so that the operating element is fixed in the conductor clamping position such that rotation is prevented. In this way, it is possible to ensure, in particular, that the operating element is not unintentionally operated and, respectively, the clamping limb is not unintentionally moved to the conductor release position.

The contact frame can have a conductor insertion opening which is preferably situated behind the conductor clamping point in the conductor insertion direction.

The clamping spring can have a supporting limb with which the clamping spring is held and supported on the contact frame, preferably is suspended in the conductor insertion opening. Therefore, particularly simple fixing of the clamping spring to the contact frame together with optimized spring action of the clamping spring at the same time is provided.

Furthermore, the clamping limb can be pretensioned against the contact frame into the conductor clamping point, preferably by means of a preferably arcuate connecting limb which connects the clamping limb to the supporting limb.

The clamping limb can have a region for making contact with the operating element, which region is preferably provided between the region which connects the limbs and a further part of the clamping limb, which further part has the free end of the clamping limb, wherein this region extends laterally, preferably on either side of the further part and preferably in the conductor insertion direction. As a result, the region can be provided in such a way that it has virtually elongated lugs which provide improved support for the operating element for moving the clamping limb.

The contact frame and the contact spring can be provided and formed in relation to one another in such a way that the free end of the clamping limb does not enter the conductor insertion opening when said clamping limb is moved between the conductor clamping position and the conductor release position. In other words, the contact body and the contact spring can be provided and formed in relation to one another in such a way that the clamping limb, in particular the free end thereof, is always provided outside the conductor insertion opening and is preferably at most at a tangent to the conductor insertion opening. As a result, tilting of the clamping limb with the contact frame can be prevented, this being advantageous, in particular, in terms of wear and, respectively, service life of the terminal.

The insulating material housing can further have a conductor insertion channel which extends toward the conductor clamping point. The clamping limb preferably extends transversely through the conductor insertion channel and toward the conductor clamping point substantially in the conductor insertion direction in an inclined manner.

Furthermore, a clamping arrangement can have at least two of the abovementioned terminals, wherein (at least) the contact frames are integrally formed with one another. For example, electrical energy can be transmitted or tapped off between the at least two terminals by means of the contact frame here.

The conductor clamping points and associated operating elements are preferably arranged next to one another in a row, preferably with parallel or coaxially oriented rotation axes. A guide web (also called a web in the text which follows) preferably extends between in each case two adjacent operating elements in order to preferably axially space apart the operating elements from one another. This web ensures housing-side, secure guidance of the operating elements. Furthermore, the provision of the operating elements, which are laterally spaced apart from one another by means of a small gap (for example approximately 0.1-0.2 mm) by the web, allows for secure guidance of the operating elements (functionally) independently of adjacent operating elements.

Figure 1B:
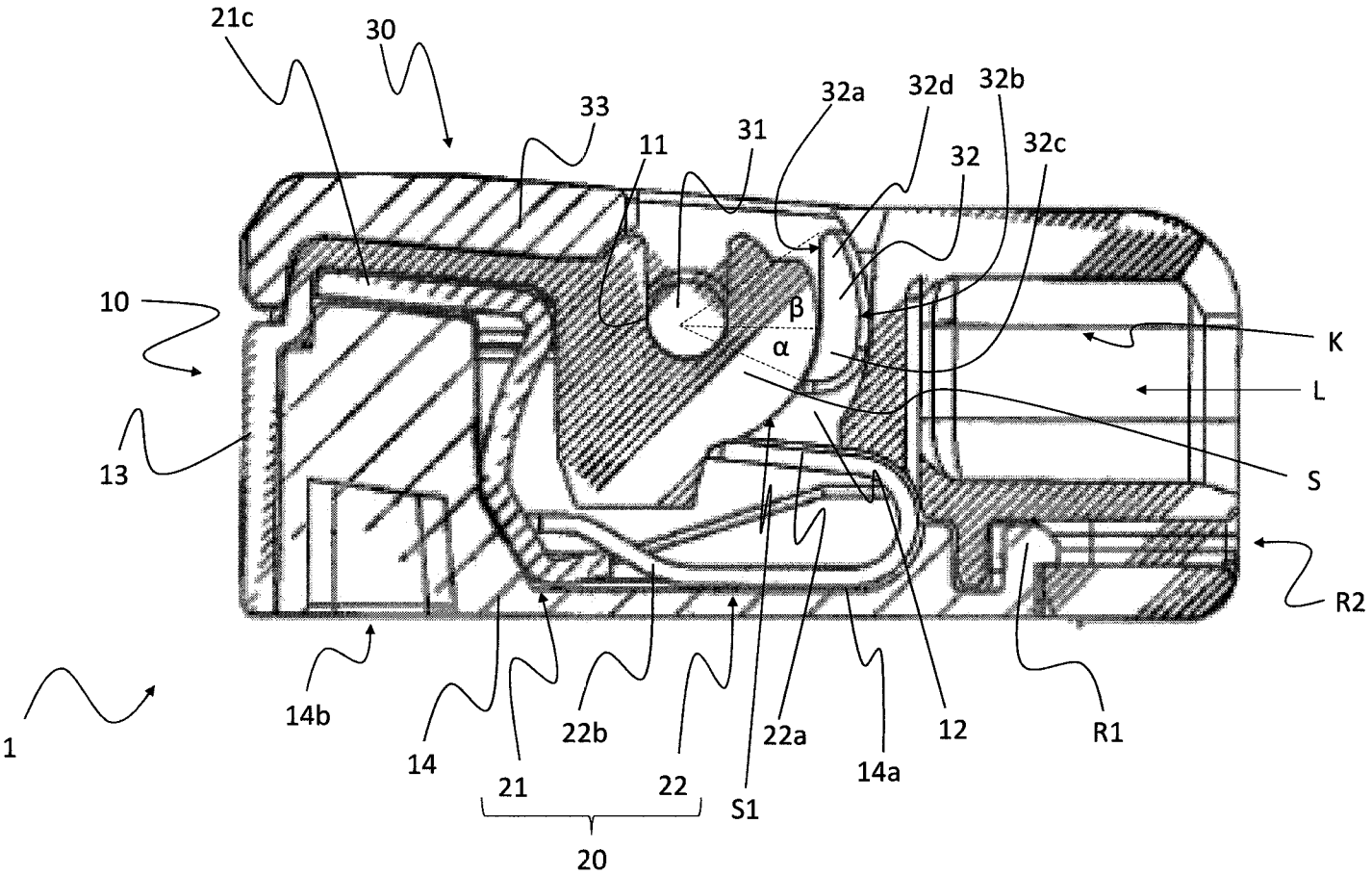
Figure 1C:
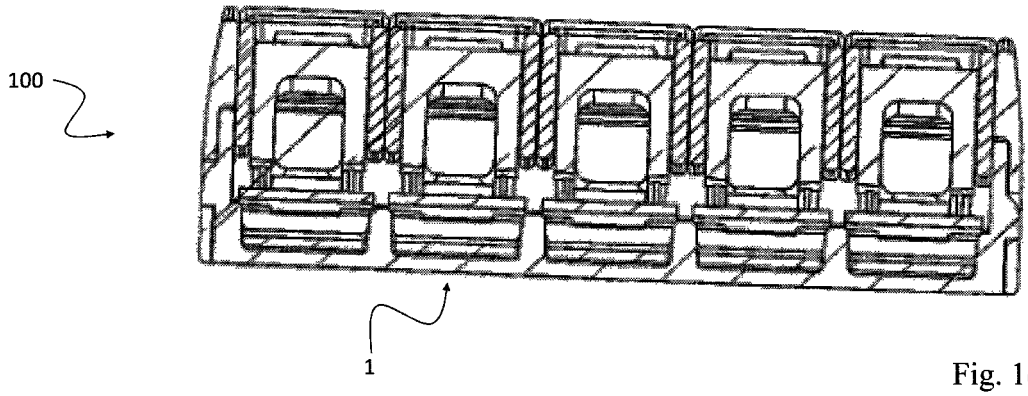
Figure 1D:
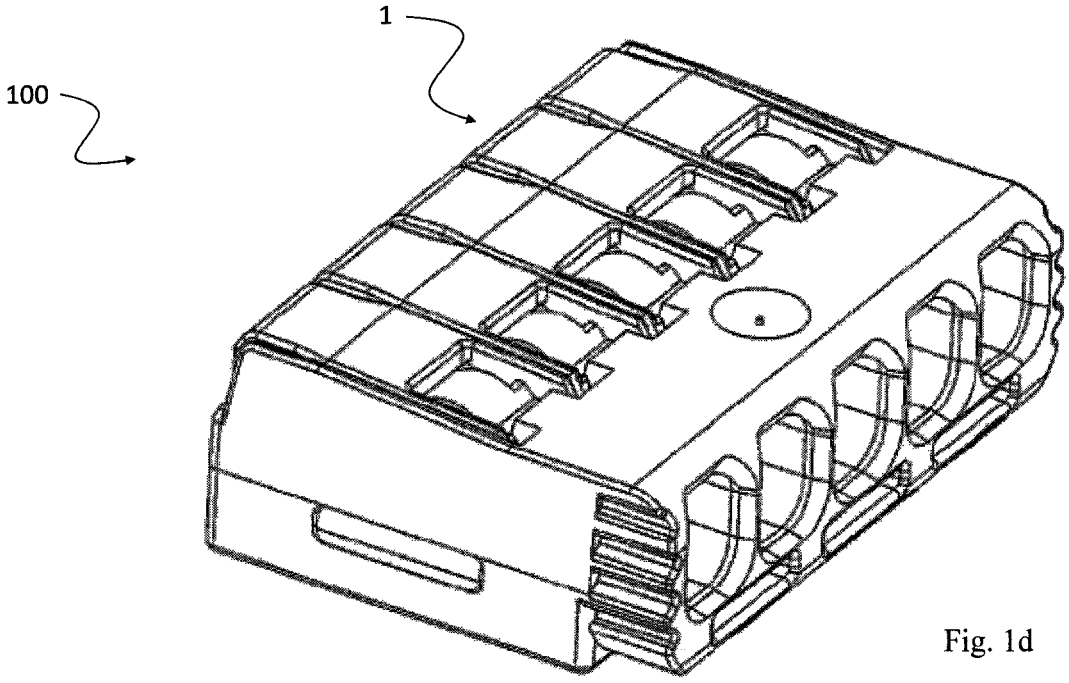
Figure 2A:
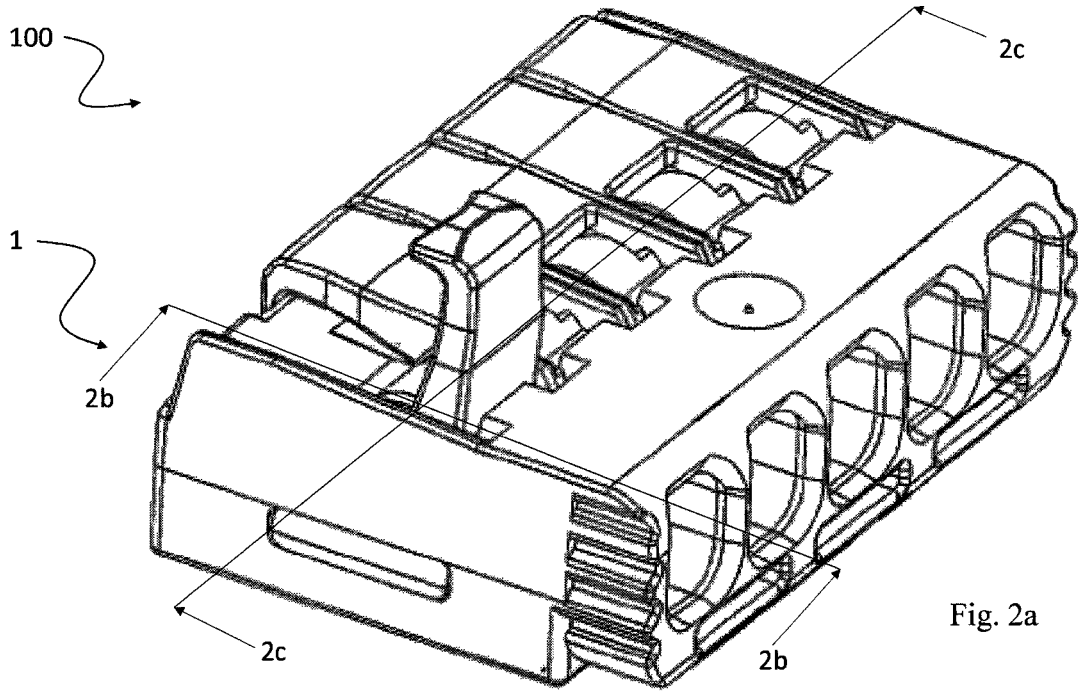
Figure 2B:
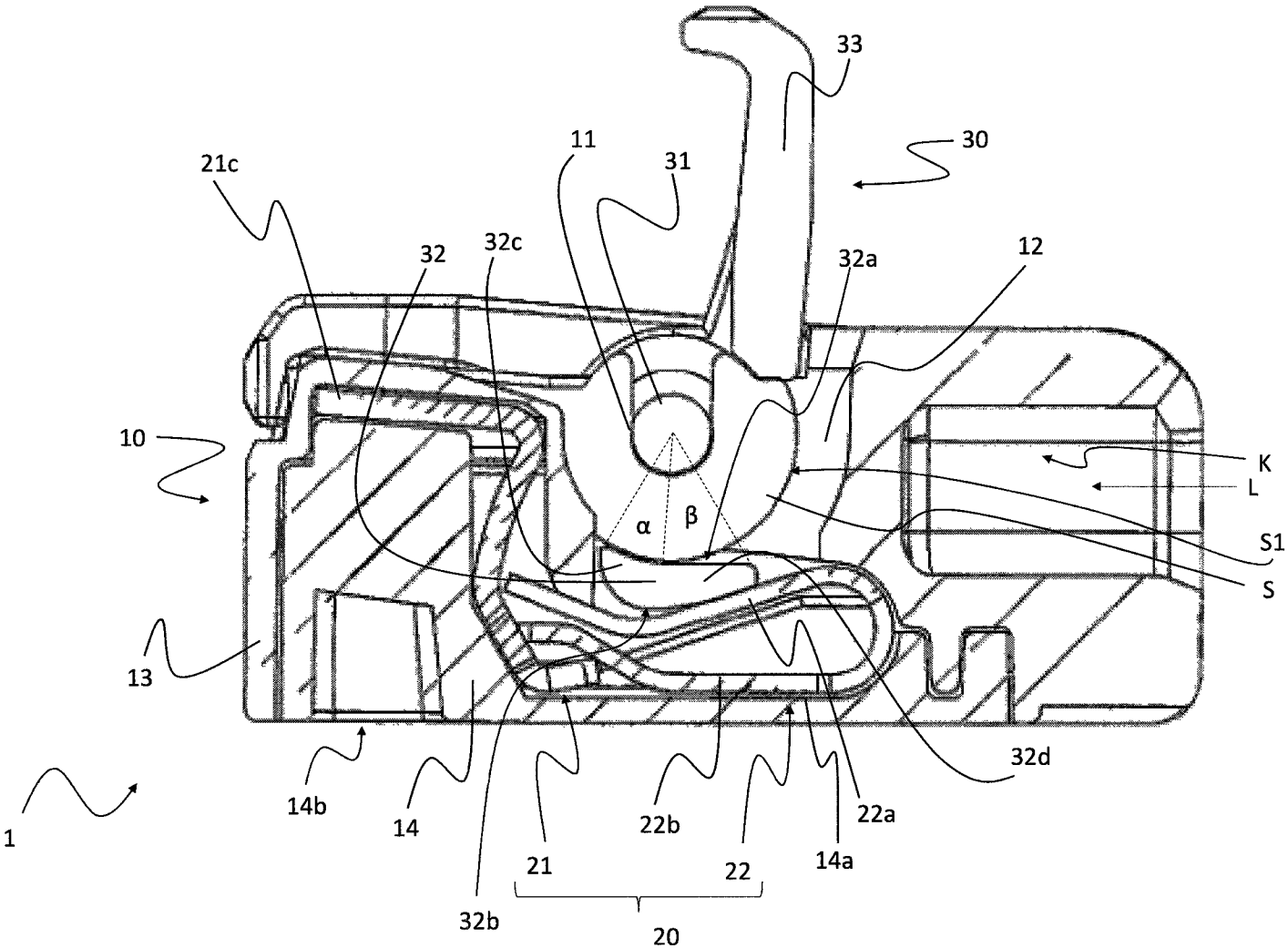
Figure 2C:
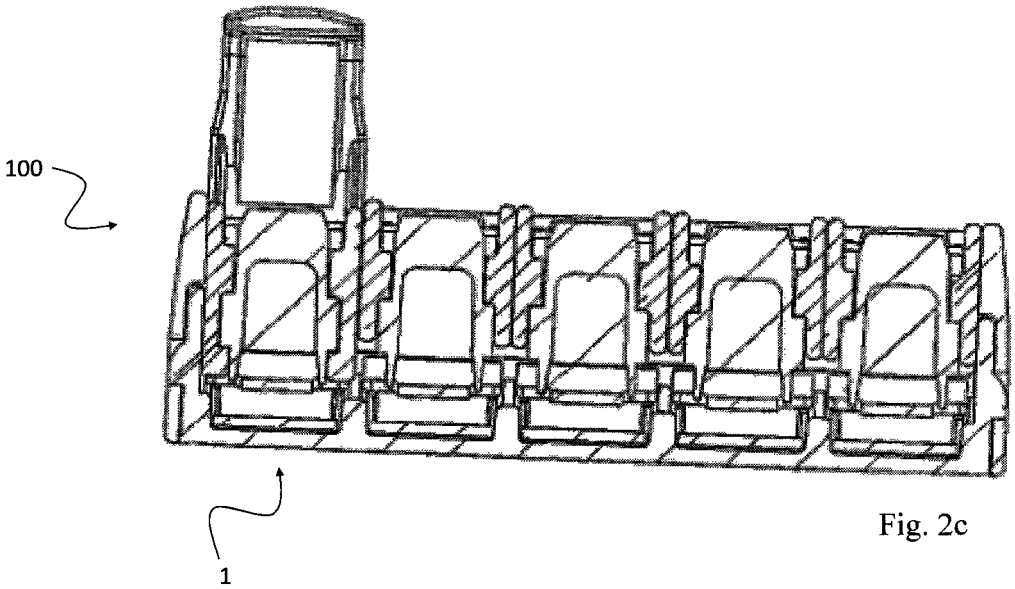
Figure 3D:
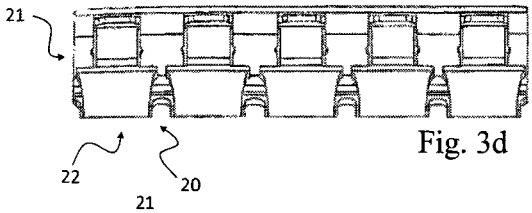
Figure 3A:
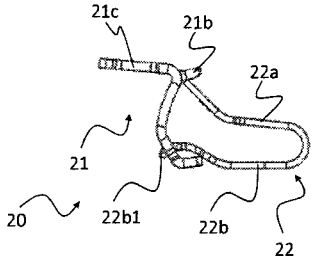
Figure 3E:
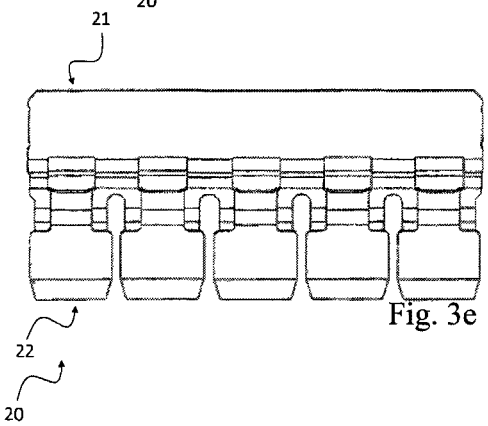
Figure 3B:
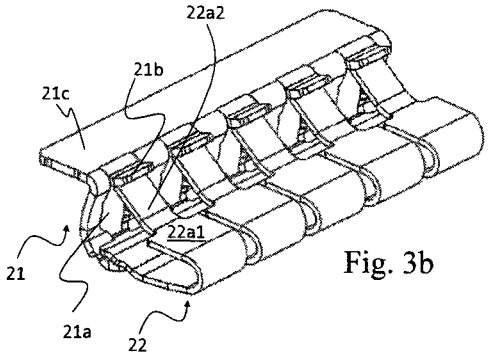
Figure 3C:
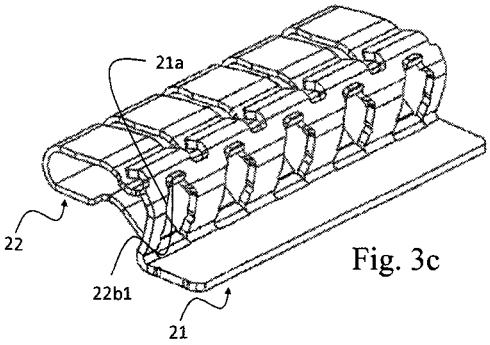
Figure 4A:
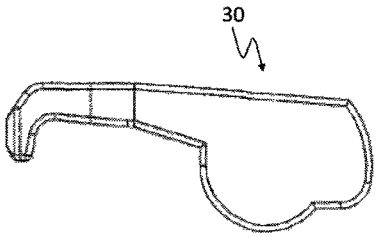
Figure 4B:
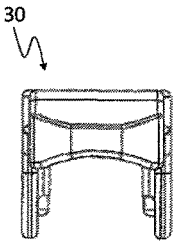
Figure 4C:
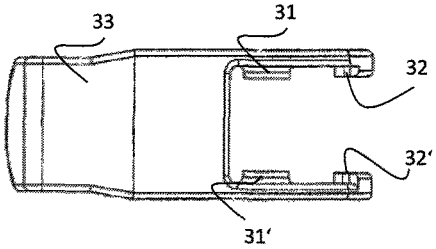
Figure 4D:
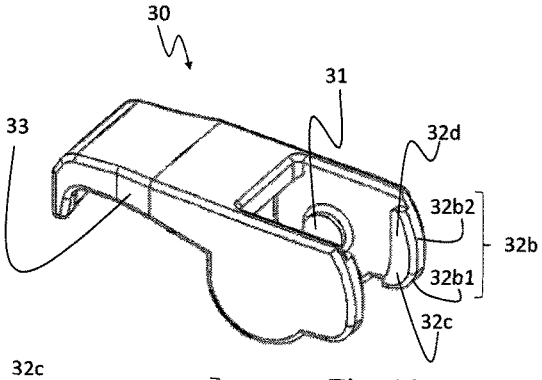
Figure 4E:
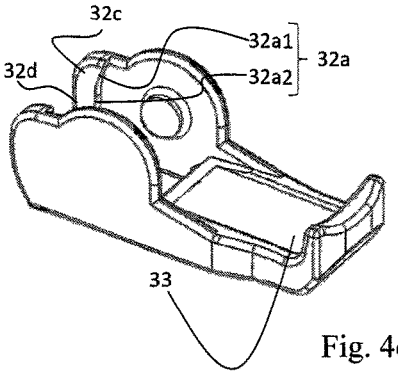
Figure 5:
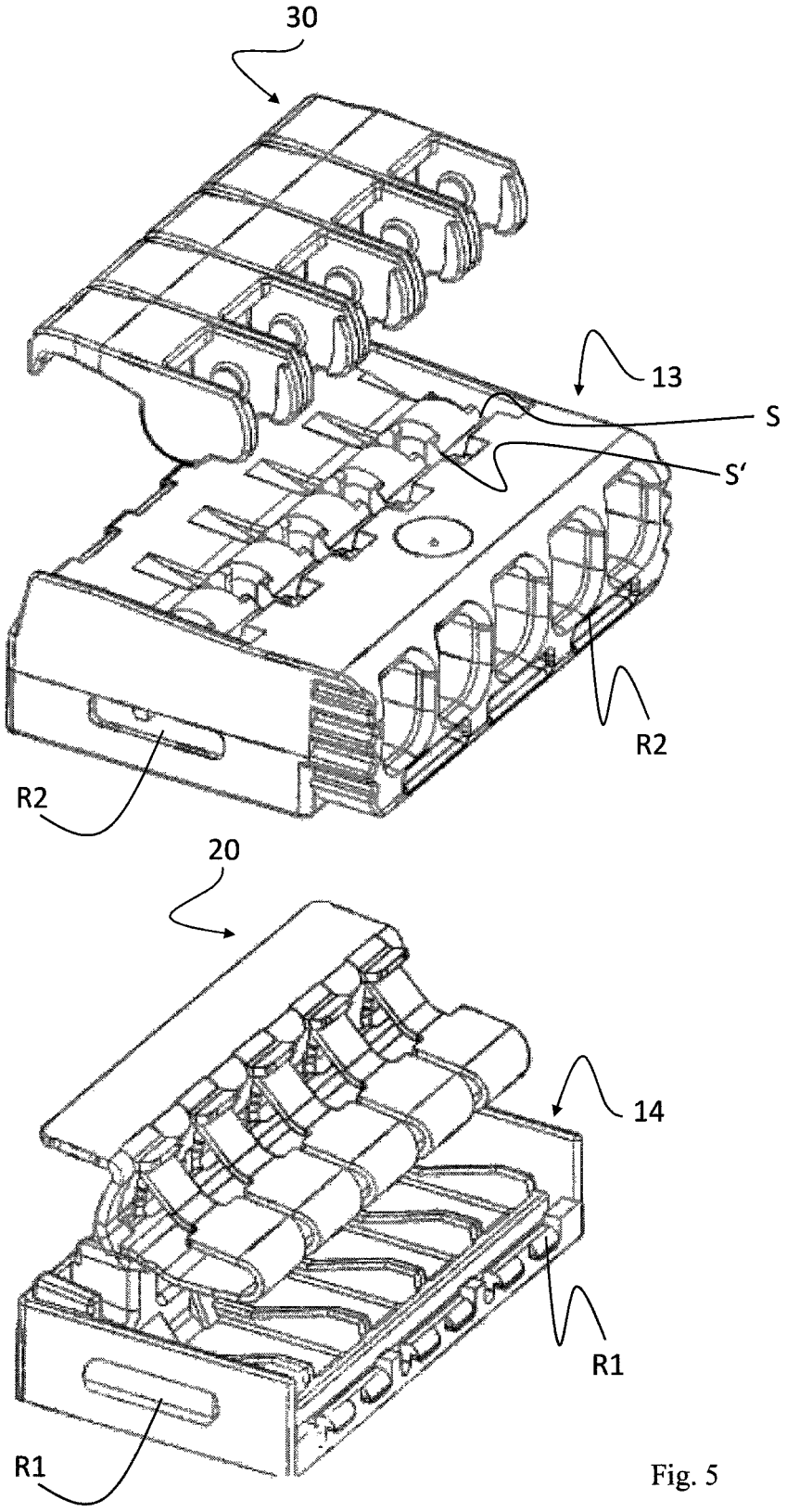
Figure 6B:
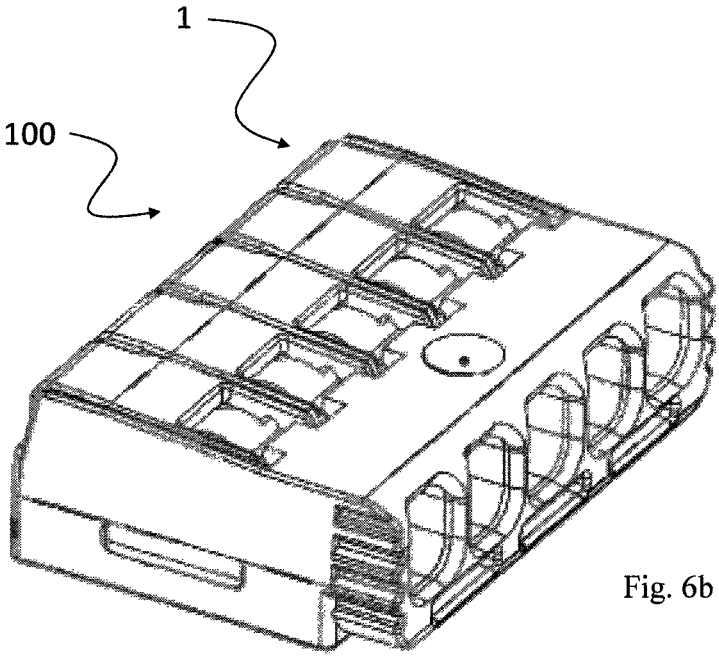
Figure 6A:
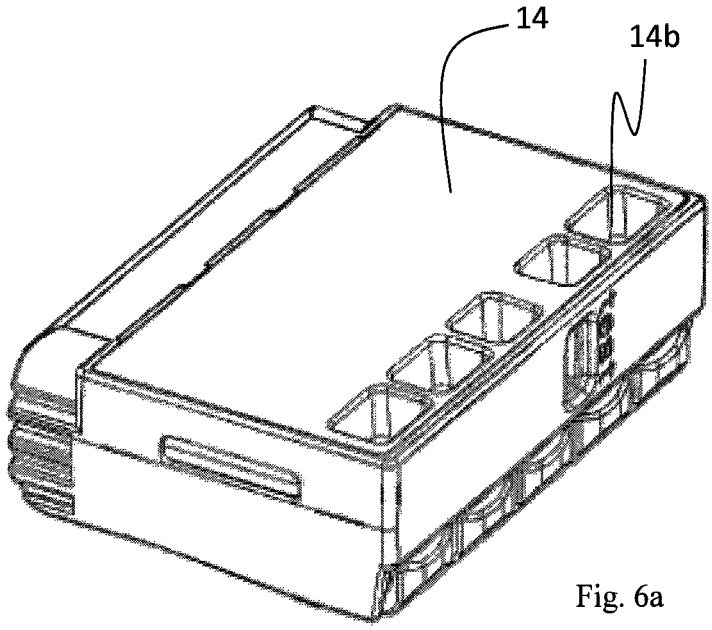
Figure 7:
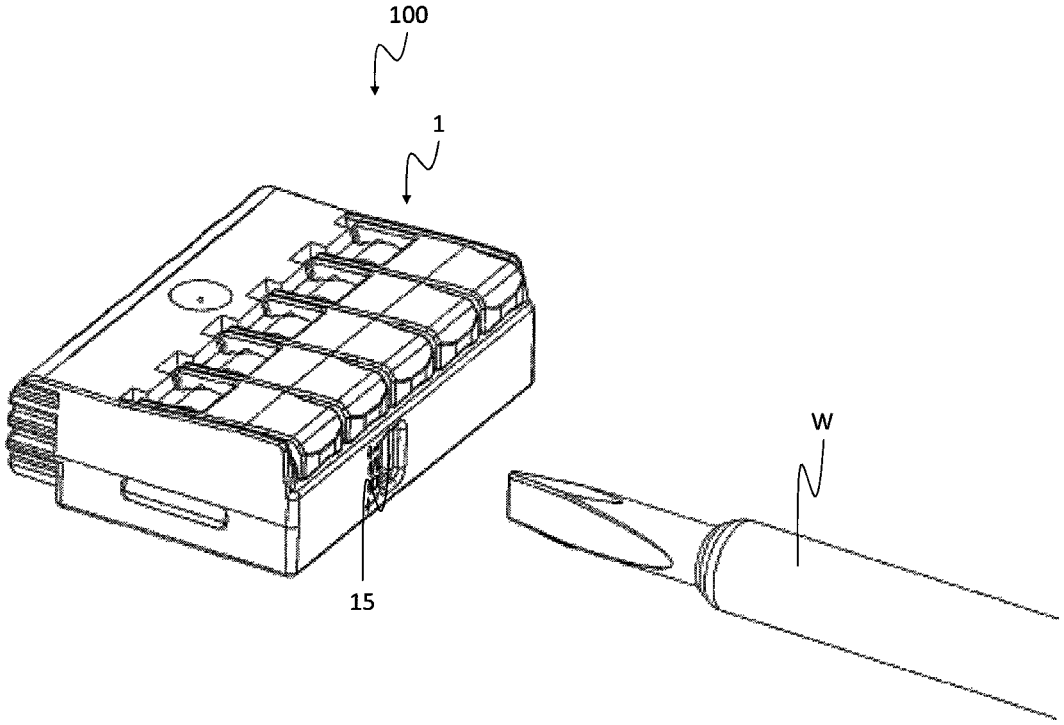
Figure 8A:
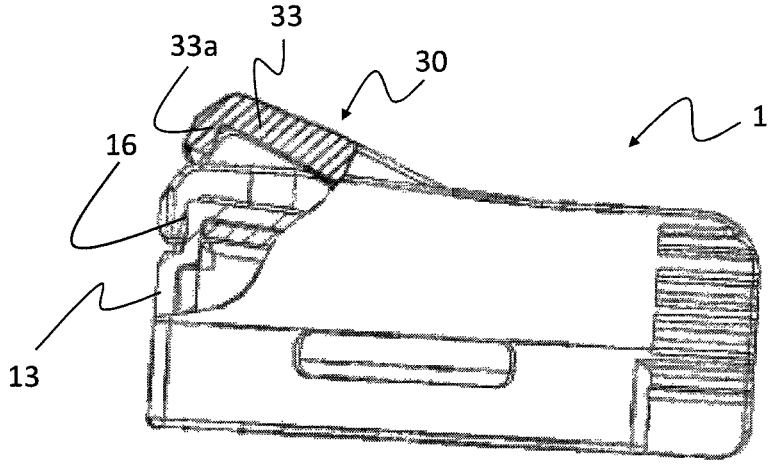
Figure 8B:
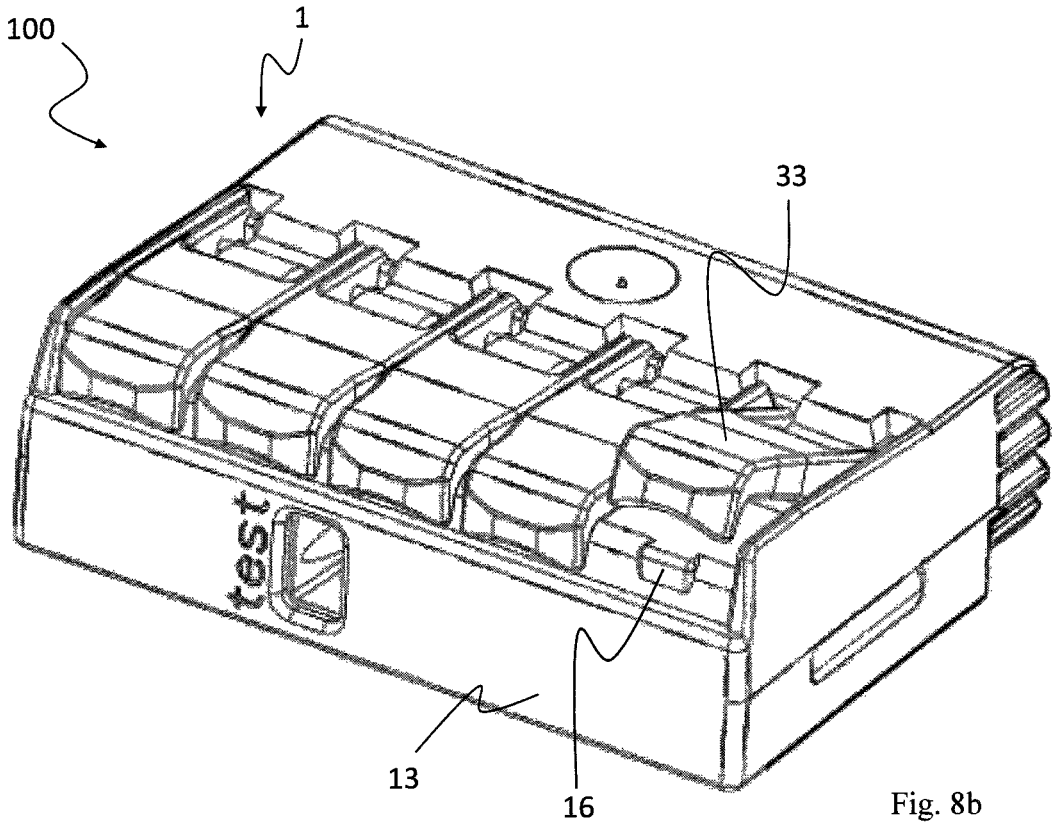
Figure 9A:
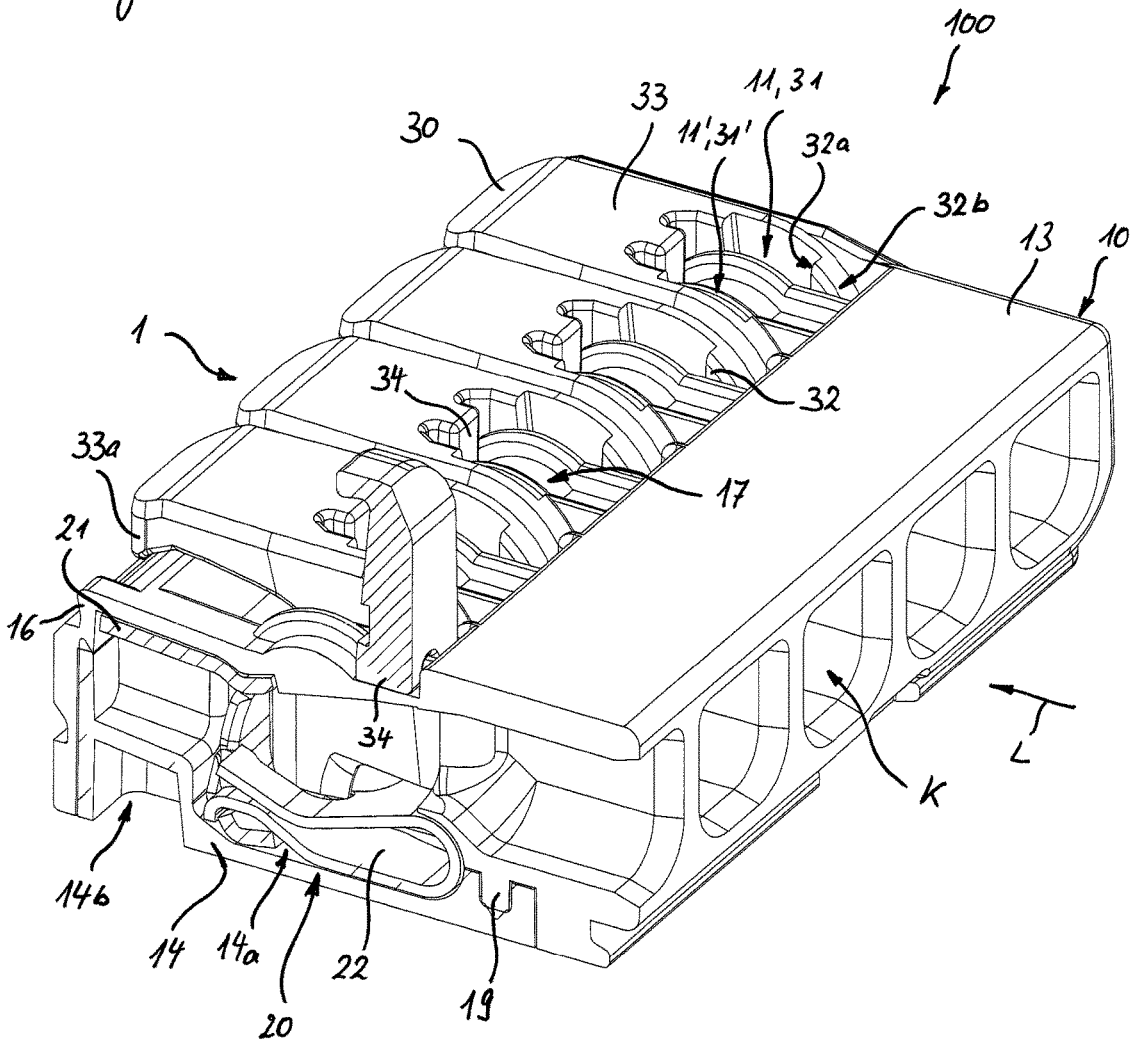
Figure 10A:
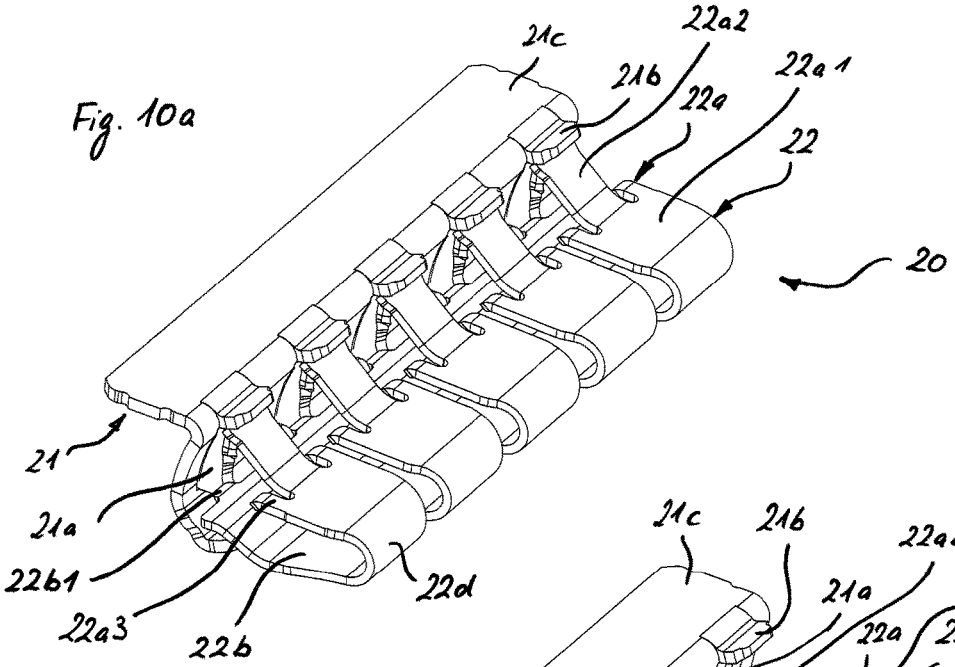
Figure 10B:
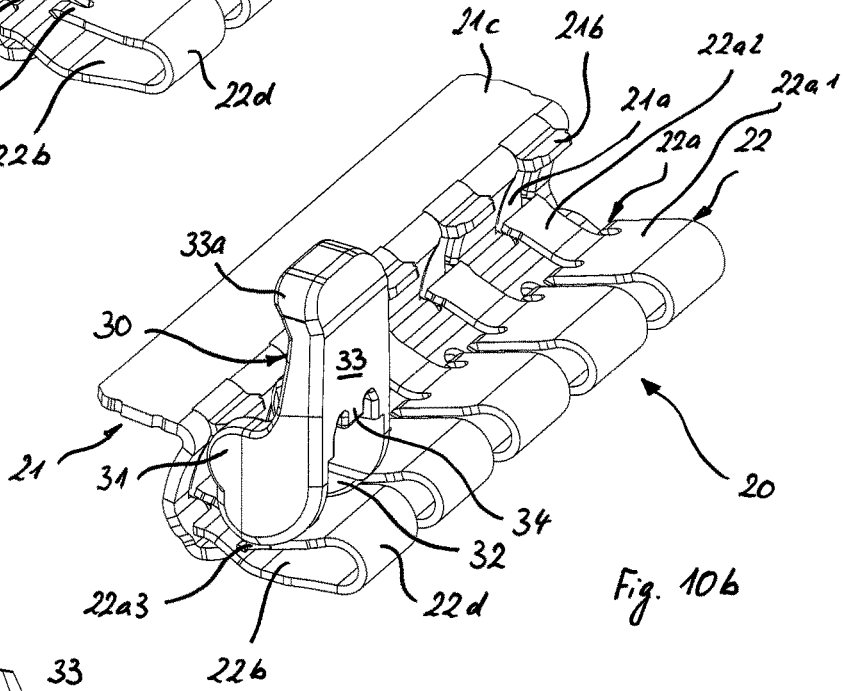
Figure 10C:
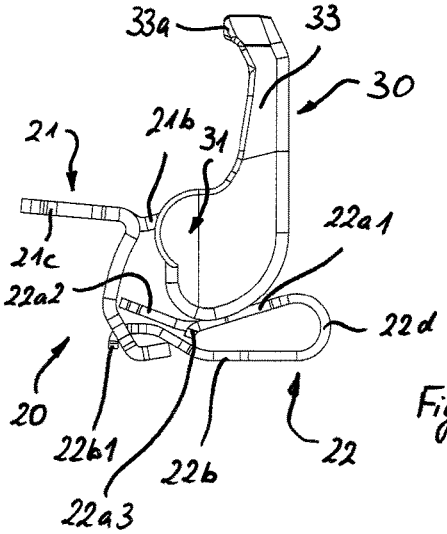
Figure 11:
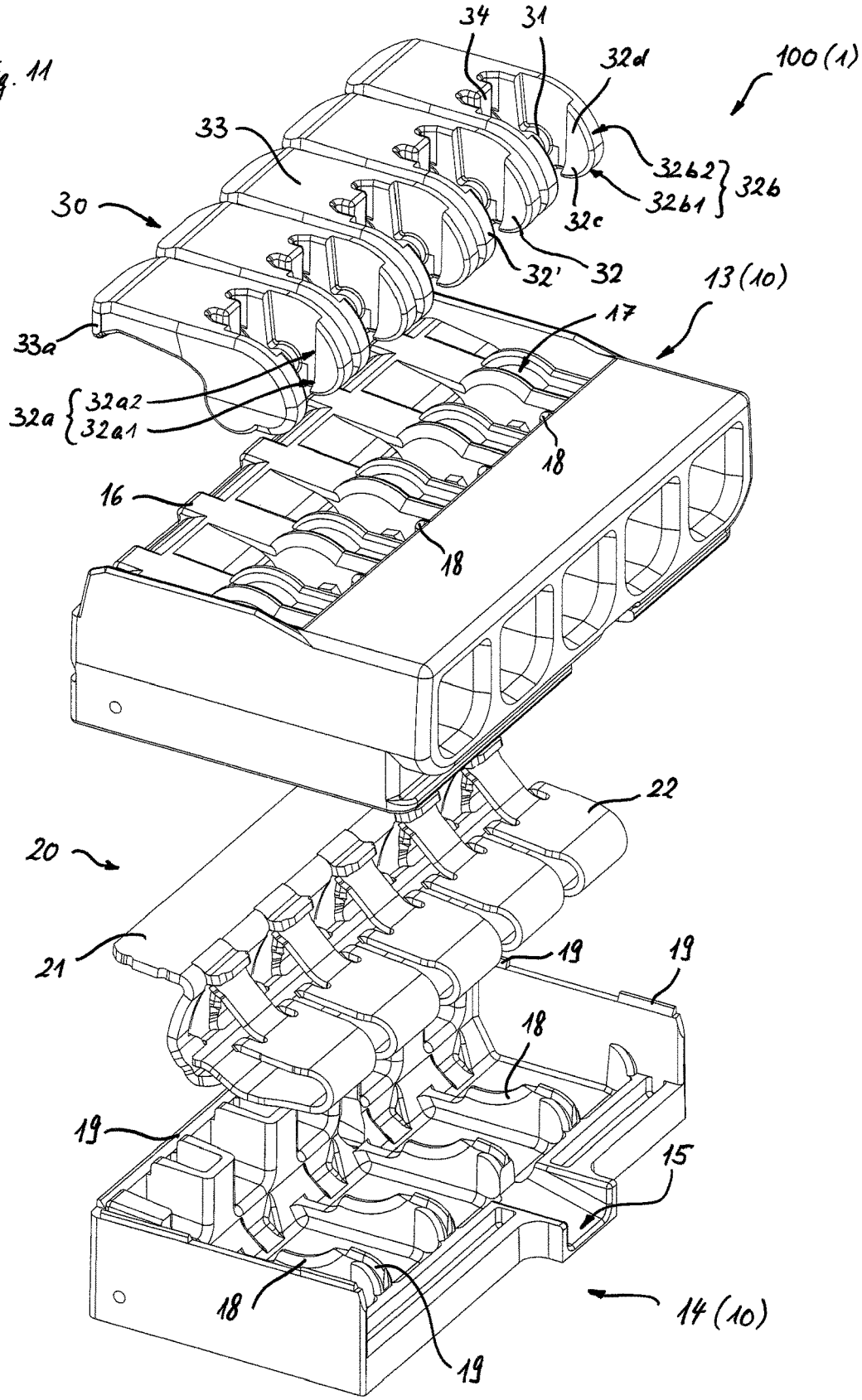

Further refinements and advantages of the present invention will be described with reference to the Figures of the accompanying drawings, in which:

FIG. 1*a* shows a plan view of a terminal according to the invention in line with one exemplary embodiment of the invention in the conductor clamping position, FIG. 1*b* shows a sectional view along section line 1*b*-1*b* of the terminal in accordance with FIG. 1*a*, FIG. 1*c* shows a sectional view along section line 1*c*-1*c* of the terminal in accordance with FIG. 1*a*, FIG. 1*d* shows a perspective view of the terminal in accordance with FIGS. 1*a* to 1*c*, FIG. 2*a* shows a perspective view of the terminal according to the invention in line with the exemplary embodiment of the invention in accordance with FIG. 1*a* in the conductor release position, FIG. 2*b* shows a sectional view along section line 2*b*-2*b* of the terminal in accordance with FIG. 2*a*, FIG. 2*c* shows a sectional view along section line 2*c*-2*c* of the terminal in accordance with FIG. 2*a*, FIGS. 3*a* to 3*e* show various views of an exemplary embodiment of a contact body of the terminal according to the invention in accordance with FIG. 1*a*, FIGS. 4*a* to 4*e* show various views of an exemplary embodiment of an operating element of the terminal according to the invention in accordance with FIG. 1*a*, FIG. 5 shows an exploded illustration of the exemplary embodiment of the terminal according to the invention in accordance with FIG. 1*a*, FIGS. 6*a* and 6*b* show a perspective view from below and, respectively, from above of the exemplary embodiment of the terminal according to the invention in accordance with FIG. 1*a*, FIG. 7 shows a perspective view of the exemplary embodiment of the terminal according to the invention in accordance with FIG. 1*a* with a phase tester, FIGS. 8*a* and 8*b* show a side view and, respectively, a perspective view of the exemplary embodiment of the terminal according to the invention in accordance with FIG. 1*a*, FIG. 9*a* shows a perspective partially sectional view of a terminal according to the invention in accordance with a second exemplary embodiment of the invention in the conductor release position, FIG. 9*b* show a front view of the terminal according to the invention in accordance with FIG. 9*a* in the conductor clamping position, FIG. 9*c* shows a sectional side view of the terminal according to the invention in accordance with FIG. 9*b* along section line 9*c*-9*c*, FIG. 9*d* shows a plan view of the terminal according to the invention in accordance with FIG. 9*b*, FIGS. 10*a* to 10*c* show various views of a further exemplary embodiment of a contact body of the terminal according to the invention in accordance with FIG. 9*a*, in some cases with the operating element, and FIG. 11 shows an exploded illustration of the second exemplary embodiment of the terminal according to the invention in accordance with FIG. 9*b*.

FIGS. 1*a* to 8*b* show a terminal 1 according to one exemplary embodiment of the invention. FIGS. 9*a* to 11 show a terminal 1 according to a second exemplary embodiment of the invention. The terminals 1 are substantially identical, and therefore the following statements in principle apply to both exemplary embodiments equally, unless stated otherwise. Identical features are provided with the same reference symbols. The terminal 1 according to the invention is, in particular, a connection or connecting terminal. Terminals 1 of this kind serve, in particular, to electrically connect at least one electrical conductor (not illustrated) in a conductor insertion direction L.

FIGS. 1*a* and 9*a* illustrate the respective terminal 1 in a particularly preferred design as part of a terminal arrangement 100. The terminal arrangement 100 has at least two, preferably five, terminals 1 for in each case one electrical conductor. However, the terminal arrangement 100 is not restricted to the number of terminals 1 here. The terminals 1 are preferably arranged in a row next to one another. The structure of the terminal 1 will be described in the text which follows. The terminal 1 has an insulating material housing 10 and a contact body 20 which is accommodated in the insulating material housing 10. The insulating material housing 10 can have a conductor insertion channel K which preferably prespecifies or defines the conductor insertion direction L. The contact body 20 is illustrated by way of example in FIGS. 3*a* to 3*e* and also 10*a* to 10*c*. It can be seen in said Figures that the contact body 20 has a contact frame 21. The contact frame 21 is provided in order to provide electrical coupling between an electrical conductor and a further element which is connected to the contact frame 21. The contact frame 21 is preferably configured as a stamped and/or bent part.

The contact body 20 further has a contact spring 22. Here, the contact spring 22 has a clamping limb 22*a* which provides a conductor clamping point for electrically connecting the conductor together with the contact frame 21. That is to say, the clamping terminal 22*a* is pretensioned in the direction of the contact frame 21 or the clamping limb 22*a* is pretensioned against the contact frame 21 into the conductor clamping position. Furthermore, the clamping limb 22*a* can be moved between a conductor clamping position and a conductor release position. The conductor clamping position is illustrated by way of example in FIGS. 1*b* and 9*c*. The conductor release position is illustrated by way of example in FIG. 2*b* or 9*a* and 10*b* (in each case with the terminal 1 illustrated at the bottom). It can in particular be seen in said figures that the clamping limb 22*a* preferably extends transversely through the conductor insertion channel K, which extends toward the conductor clamping point, and toward the conductor clamping point substantially in the conductor insertion direction L in an inclined manner.

As is likewise illustrated in FIGS. 3*a* to 3*e* and also 10*a* to 10*c* in particular, the contact body 21 can have a conductor insertion opening or cutout 21*a* which is situated behind the conductor clamping point in the conductor insertion direction L. The conductor insertion opening 21*a* can be provided, for example, for suspending the contact spring 22. The clamping spring 22 can have a supporting limb 22*b* with which the clamping spring 22 is held and supported on the contact frame 21, preferably is suspended in the conductor insertion opening 21*a*. It can be provided, in particular, that the supporting limb 22*b* is suspended in the conductor insertion opening 21*a* by means of the free and, particularly preferably, bent-over end 22*b*1 of the supporting limb 22*b*. Here, the supporting limb 22*b* is preferably integrally formed with the clamping limb 22*a*, particularly preferably by means of a preferably arcuate connecting limb 22*b* which connects the clamping limb 22*a* to the supporting limb 22*b*. Here, the clamping limb 22*a* and the supporting limb 22*b* preferably form a substantially U-shaped cross section. In particular, the supporting limb 22*b* can be provided such that it does not move with respect to the contact frame 22, so that it provides the spring action for the clamping limb 22*a*.

Furthermore, FIGS. 3*b* and 3*c* and also 10*a* and 10*b* illustrate that the conductor insertion opening 21*a* can be provided for routing a conductor. In a preferred embodiment, as is illustrated in FIGS. 1*b* and 2*b* and also 9*a* and 9*c* in particular, the contact frame 21 and the contact spring 22 are preferably provided and formed in relation to one another in such a way that, both in the conductor release position (FIGS. 2*b* and 9*a*) and also in the conductor clamping position (FIGS. 1*b* and 9*c*), the free end of the clamping limb 22*a* does not enter the conductor insertion opening 21*a*, that is to say in particular the free end of the clamping limb 22*a* does not enter the conductor insertion opening 21*a* when it moves between the conductor clamping position and the conductor release position. To this end, it can be provided, for example, that the free end of the clamping limb 22*a* is in a position which is not situated in the conductor insertion opening 21*a* both in the conductor clamping position and also in the conductor release position. This can be achieved preferably by the distance between the free end of the clamping limb 22*a* and the region which connects the limbs 22*a* and 22*b* to one another being smaller than the distance between the free end 22*b*1 of the supporting limb 22*b* and that region of the limbs 22*a* and 22*b* which connects them.

Furthermore, the contact frame 21 can have a contact tongue 21*b*. The contact tongue 21*b* can be formed, for example, by the conductor insertion opening 21*a*. That is to say that the contact tongue 21*b* can be provided on an edge region of the conductor insertion opening 21*a*. In the conductor clamping position, the contact tongue 21*b* serves for the electrical conductor (not illustrated) to make contact with the contact frame 21. The contact tongue 21*b* serves for supporting the free end of the clamping limb 22*a* when the conductor is not inserted and in the conductor clamping position. This position, that is to say a position in which no electrical conductor is inserted and in which the contact spring is located in the conductor clamping position, is illustrated by way of example in FIGS. 3*a* to 3*c* and also 10*a*.

The terminal 1 further has an operating element 30 in order to move the clamping limb 22*a* between the conductor clamping position and the conductor release position. FIGS. 2*b* and also 9*a*, 10*b* and 10*c* illustrate, by way of example, how the operating element 30 stops the clamping limb 22*a* in the conductor release position. FIGS. 1*b* and 9*c* illustrate the situation in which the operating element 30 is not in operative contact with the clamping limb 22*a*, so that the clamping limb 22*a* transmits a clamping force to the contact frame 21 in the conductor clamping position. For the purpose of rotatably mounting the operating element 30, the operating element 30 further has a bearing region 31 for rotatably mounting the operating element 30 in the insulating material housing 10. The operating element 30 can therefore be rotated about a rotation axis which is, by way of example, perpendicular to the plane of the drawing in FIGS. 1*b* and 2*b* and also 9*c* and 10*c*. Here, the bearing region 31 is preferably rotatably mounted in an at least partially corresponding bearing region 11 in the insulating material housing 10. To this end, the bearing region 31 can, for example, be in the form of a projection, and the bearing region 11 can be in the form of a recess which is formed in the insulating material housing 10, in particular in the form of a groove, that is to say preferably in the form of a groove which is accessible from the outside.

Furthermore, the operating element 30 has at least one operating structure 32 which is at a radial distance from the bearing region 31 and extends in the direction of the rotation axis. Here, the operating structure 32 is provided for moving the clamping limb 22*a*. More precisely, owing to the rotational movement of the operating element 30 about its rotation axis, the operating structure 32 should move the clamping limb 22*a* between the conductor clamping position and the conductor release position (and back). That is to say, the operating structure 32 is preferably in contact with the clamping limb 22*a* in the conductor release position (FIGS. 2*b* and 9*a*), wherein the operating structure 32 is preferably at a distance from the clamping limb 22*a* in the conductor clamping position (FIGS. 1*b* and 9*c*).

As illustrated in FIGS. 2*b* and also 9*a* and 10*b* in particular, the operating structure 32 is therefore in contact with the clamping limb 22*a* in the conductor release position. To this end, it can be provided, in particular, that the operating structure 32 axially extends only to such an extent that it is in contact only with an edge region of the clamping limb 22*a*, wherein the edge region extends in the conductor insertion direction here. In particular, it can be provided that this edge region extends only on a portion of the clamping limb 22*a*, specifically on the region 22*a*1 (compare, for example, FIGS. 3*b* and 10*a*). The region 22*a*1 is preferably provided between that region 22*c* which connects the limbs 22*a*, 22*b* and a further part 22*a*2 of the clamping limb 22*a*, which further part has the free end of the clamping limb 22*a*. The further part 22*a*2 is preferably of narrower design than the part 22*a*1. In a preferred refinement, as illustrated in FIGS. 10*a* and 11 in particular, the (edge) region 22*a*1 can extend laterally, in particular on either side of the further part 22*a*2, preferably in the conductor insertion direction. The elongated lugs 22*a*3 which are provided in this way can provide improved support for the operating element 30 for moving the clamping limb 22*a* (cf., for example, FIGS. 10*b* and 10*c*).

The operating element 30 can further have an operating lever 33 by means of which the operating element 30 can be operated or rotated. In FIGS. 4*a* to 4*e*, the operating element 30 is illustrated as a single part for better illustration; and only together with the contact body 20 in FIGS. 10*b* and 10*c*. It can be seen in said figures, in particular, that the bearing region 31 is provided between the operating lever 33 and the operating structure 32 in a plan view of the operating element 30, as is illustrated in FIG. 4*c* for example (also cf. FIG. 9*d*). That is to say, the operating structure 32 and the operating lever 33 are preferably provided on substantially opposite sides with respect to the rotation axis and/or the bearing region 31. The abovementioned elements are preferably provided in relation to one another in such a way that, in the installed state of the operating element 30 with the insulating material housing, the operating lever 33 terminates flush with the insulating material housing 10, as is illustrated, for example, in FIG. 2*b* or 9*a*.

As can be seen by way of example in FIG. 1*a*, the operating elements 30 can be supported flat on the respectively adjacent operating element 30 by way of their lateral outer surface. Therefore, a particularly compact construction is possible. However, this flat supporting abutment can lead to undesired physical interactions between the operating elements 30, in particular when the operating elements 30 are inserted (for mounting purposes) or pivoted (during operation); said operating elements can catch or tilt for example. In order to counteract this, it is conceivable, as can be seen in FIGS. 9*d* and 11 for example, that the operating element 30 has a guide section 34 which protrudes radially toward the rotation axis. Here, as shown, the guide section 34 can extend (radially) away from the operating lever 33 and preferably extend (radially) away from the center of the operating lever 33 with respect to the axial direction of the rotation axis. The guide section 34 is preferably accommodated, that is to say guided, in a sliding manner in a radial guide groove 17 of the insulating material housing 10, which radial guide groove runs at least partially around the rotation axis, in order to axially guide the operating lever 30 on either side in the event of rotational movement of said operating lever about the rotation axis. The guide groove 17 is preferably accommodated or guided in a sliding manner in the bearing region 11 of the insulating material housing 10, which bearing region 11 interacts with the bearing region 31 for rotatably mounting the operating element 30. The guide groove 17 is preferably located on a (here outer) side of the insulating material housing 10, which side is averted from the contact body 20, and furthermore preferably extends in an arcuate manner or in the form of a segment of a circle partially around the rotation axis. By means of this central guidance, the operating element 30 can be securely mounted and operated (pivoted) independently of adjacent operating elements 30.

The conductor clamping points and associated operating elements 30 are arranged next to one another in a row here. This is preferably done with parallel or—as illustrated—coaxially oriented rotation axes. A (guide) web 18 preferably extends between in each case two adjacent operating elements 30 in order to preferably axially space apart the operating elements 30 from one another; for example with a defined gap in the range of approximately 0.1-0.2 mm. This web 18 ensures secure housing-side guidance of the operating elements 30 while avoiding undesired interaction between adjacent operating elements 30 and with a very compact construction overall.

As illustrated in FIGS. 1*b* and 2*b* and also 9*a* and 9*c* in particular, the insulating material housing 10 further has a supporting region S. As illustrated in FIG. 2*b* in particular, the supporting region S axially extends between the rotation axis and the operating structure 32 in such a way that the operating structure 32 is supported on the supporting region S at least in the conductor release position, preferably also in the conductor clamping position (FIGS. 1*b* and 9*c*). To this end, it can be provided, for example, that the supporting region extends from the bearing region 31 or 11 to the operating structure 32, that is to say the bearing region 11 is preferably formed in the supporting region S.

As illustrated in FIG. 2*b* in particular, it can be provided that the operating structure 32 is supported on the supporting region S in the conductor release position in such a way that the operating element 30 is captively held at least in the conductor release position.

As illustrated in FIG. 1*b* in particular, the supporting region S can further extend between the rotation axis and the operating structure 32 in such a way that the operating element 30 is captively held in the conductor clamping position. To this end, it can be provided, for example, that the operating structure 32 engages behind the supporting region S. Engagement behind the supporting region S by the operating structure 32 can also be such that the operating element 30 can snap into the insulating material housing 10. Therefore, the operating structure 32 and the supporting region S preferably form a snap-action closure.

According to one particularly preferred embodiment, the operating structure 32 is formed in such a way that it inhibits a rotational movement of the operating element 30 in the conductor release position by contact with the clamping limb 22*a*, wherein the rotational movement is at least one rotational movement for moving the clamping limb 22*a* from the conductor clamping position to the conductor release position. This position is illustrated by way of example in FIGS. 2*b* and 9*a*. It is clear that the contact between the operating structure 32, in particular an end region of the operating structure 32, and the clamping limb 22*a* prevents or inhibits a further rotational movement of the operating element 30 (here: in the clockwise direction).

In particular, it is clear from FIGS. 1*b* and 2*b* and also 10*b* and 10*c* that a supporting face S1 of the supporting region S, on which the operating structure 32 is supported, can be at a constant radial distance from the rotation axis. That is to say, the supporting region S or the supporting surface S1 is preferably designed in the form of a segment of a circle, wherein the center point of this circle is situated on the rotation axis.

As illustrated in particular in FIGS. 1*b* and 2*b* and also 4*d* and 4*e* and also 10*b*, the operating structure 32 can have a side 32*a* which is directed toward the bearing region 31, preferably toward the supporting region S. Here, the side 32*a* has a first part 32*a*1 which is preferably in the form of a segment of a circle or is round and is at a constant radial distance from the bearing region 31 and preferably from the supporting region S. That is to say, circles, which form the bearing region 31 and the first part 32*a*1, are preferably provided coaxially on the operating element 30. The part 32*a*1 is preferably designed in a manner corresponding to the supporting face S1 of the supporting region S and is in contact with said supporting region. The first part 32*a*1 can be provided at an angle α in the range of from 15° to 40° with respect to the rotation axis of the operating element 30. In a preferred embodiment, the angle α lies in a range of from 20° to 35°, particularly preferably in a range of from 22° to 26°. In a highly preferred embodiment, the angle α is 24°. In FIGS. 1*b* and 2*b*, the point of intersection of the rotation axis with the plane of the drawing forms the vertex of the abovementioned angle α.

As illustrated in FIGS. 1*b* and 2*b*, it can be provided that the first part 32*a*1 is supported on or makes contact with the supporting region S both in the conductor clamping position (FIGS. 1*b*, 9*a*) and also in the conductor release position (FIG. 2*b*, 9*c*). Therefore, the supporting region S and the first part 32*a*1 are preferably configured in a corresponding manner.

The side 32*a* of the operating structure 32 can further have a second part 32*a*2 which preferably continuously adjoins the first part 32*a*1 and which is at a radially increasing distance from the bearing region 31 and preferably from the supporting region S. As illustrated, for example, in FIGS. 1*b* and 11, it can be provided that the part 32*a*2 is substantially perpendicular in relation to the conductor insertion direction in the conductor clamping position. In the conductor release position (FIGS. 2*b* and 10*b*), the part 32*a*2 can be provided at an angle β of from 20° to 40°, preferably of from 25° to 40°, particularly preferably of from 30° to 35° with respect to the rotation axis. In a highly preferred embodiment, the angle is 33°. In FIGS. 1*b* and 2*b*, the point of intersection of the rotation axis with the plane of the drawing forms the vertex of the abovementioned angle β.

As illustrated in FIGS. 1*b* and 2*b*, it can also be provided that the second part 32*a*2 is at a distance from the supporting region S both in the conductor clamping position (FIG. 1*b*) and also in the conductor release position (FIG. 2*b*).

The operating structure 32 can also have a side 32*b* which is averted from the bearing region 31 and, respectively, from the supporting region S and which can be clearly identified, in particular, in FIGS. 4*d* and 11. The sides 32*a* and 32*b* preferably enclose the operating structure 32. The side 32*d* is therefore that side of the operating structure 32 which can be brought into contact with the clamping limb 22*a*, as is shown, for example, in FIGS. 1*b* and 2*b* and also 9*a*, 9*c*, 10*b* and 10*c*. Here, the side 32*b* has a first part 32*b*1 and a second part 32*b*2 which preferably continuously adjoins the first part 32*b*1. Here, the side 32*b* is preferably configured in such a way that initially (only) the part 32*b*1 and subsequently (only) the part 32*b*1 are in contact with the clamping limb 22*a* when the operating structure 32 moves in the direction of the clamping limb 22*a*. Therefore, a particularly simple movement of the clamping limb 22*a* can be effected with a relatively low force. To this end, it can be provided, for example, that the part 32*c* of the operating structure 32, which part is delimited by the parts 32*a*1 and 32*b*1, becomes wider in the direction of the part 32*d* of the operating structure 32, which part is delimited by the parts 32*a*2 and 32*b*2, wherein the part 32*d* adjoining said part 32*c* becomes narrower as the distance from the part 32*c* increases.

As illustrated in particular in FIG. 2*b*, the front part 32*a*1 can be in force-fitting contact with the supporting region S, that is to say can be pressed against the supporting region S by means of a spring action between the clamping limb 22*a* and the operating structure 32, in particular the rear part 32*b*2 of said operating structure. As a result, the abovementioned inhibition of the rotational movement of the operating element 30 in the conductor release position can be achieved in a particularly advantageous manner.

As illustrated in particular in FIGS. 4*b* to 4*d* and also 9*d* and 11, the operating element 30 can have a further operating structure 32', wherein the operating structures 32, 32' are at an axial distance from one another and preferably extend toward one another, that is to say are preferably situated diametrically opposite one another. It can be provided, in particular, that the operating structures 32, 32' are situated opposite one another in such a way that they act on opposite ends of the clamping limb 22*a*—as seen in the conductor insertion direction. The operating structures 32, 32' are preferably of identical configuration, so that the statements made in respect of the operating structure 32 substantially equally apply to the operating structure 32'. In addition, a further supporting region S' can be provided for the operating structure 32' (FIGS. 5 and 11), which further supporting region S' is situated diametrically opposite the supporting region S and is preferably designed substantially identically to the supporting region S, so that the statements made in respect of the supporting region S substantially equally apply to the supporting region S'.

As is likewise clear from FIGS. 4*b* and 4*c* and also 9*d* in particular, the operating element 30 can further have a further bearing region 31' which is situated diametrically opposite the bearing region 31. The bearing regions 31, 31' are preferably of identical configuration, so that the statements made in respect of the bearing region 31 substantially equally apply to the bearing region 31'. That is to say, in particular, that the insulating material housing 10 can further have a further bearing region 11' which is situated diametrically opposite the bearing region 11, as is illustrated, for example, in FIGS. 1*a* and 9*d*.

As illustrated in particular in FIGS. 1*b* and 2*b* and also 9*a* and 9*c*, the supporting region S can be part of a guide groove 12 which is formed in the insulating material housing 10. The guide groove 12 can be at least partially designed in the shape a segment of a circle. Here, the guide groove 12 is provided, in particular, for guiding the operating structure 32. That is to say, the operating structure 32 can be in contact with the guide groove 12 and be supported on said guide groove here. The side 32*b* of the operating structure 32 is preferably at least partially in preferably flat contact with the guide groove 12, in particular with a side of the guide groove 12 which is directed toward the side 32*b*. It is particularly advantageous for guiding the operating structure 32 when a part of the guide 32*b* is formed in a manner corresponding to the guide groove 12 and is in contact with said guide groove 12, that is to say is guided by said guide groove 12.

Furthermore, as illustrated in FIGS. 5 and 11 in particular, the insulating material housing 10 can be of multipartite design owing to said insulating material housing having a first housing part 13 and a second housing part 14 which is connected to the first housing part 13. In this case, the connection can be made by means of a corresponding connection, such as, for example, by means of a latching connection comprising latching openings R2, which are provided in the first housing part 13, and latching lugs R1, which are provided in the second housing part 14, (cf. FIG. 5). As an alternative or in addition, it is also feasible that the housing parts 13, 14 are welded and/or adhesively bonded to one another. FIGS. 9*a* and 11 show, by way of example, a plurality of welding webs 19 for welding the housing parts 13, 14, for example by means of ultrasound welding. In the case of the multipartite design of the insulating material housing 10, it is particularly advantageous when the first housing part 13 is provided for rotatably mounting the operating element 30, that is to say has the bearing region 11 and has the supporting region S, preferably also the guide groove 12.

Furthermore, as illustrated in particular in FIGS. 1*b*, 2*b* and 5 and also 9*a*, 9*c* and 11, the contact body 20 can be accommodated between the first housing part 13 and the second housing part 14. For the purpose of securely accommodating the contact body 20, it can be provided, in particular, that the second housing part 14 has a region 14*a* such as, for example, a cutout which is provided in a manner corresponding to a part of the contact frame 21 and to a part of the contact spring 22, preferably the supporting limb 22*b*. In addition, the contact frame 21 can have a contact-making limb 21*c* which is provided between the first housing part 13 and the second housing part 14 or is preferably fixed between said housing parts in a force-fitting and/or interlocking manner.

The terminal 1 or the contact body 20 is advantageously fitted, for example, in an electronic device by means of the second housing part 14. To this end, it is possible, as illustrated in FIGS. 6 and 9*a* in particular, for the second housing part 14 to have a cutout 14*b* which extends in the direction of the contact frame 21. The cutout 14*b* can optionally run as far as the contact frame 21, so that electrical tapping-off can also be performed by means of the cutout 14*b*.

Furthermore, as illustrated in FIGS. 7 and also 9*b* and 11 in particular, the insulating material housing 10 of the terminal 1 or of the terminal arrangement 100, preferably the first housing part 13, can have a (single) test opening 15 for making contact with the contact body 20. A phase tester, such as a tool W for example, can be guided through the test opening 15 for making contact with the contact body 20.

As illustrated in FIGS. 8*a* and 8*b* and also 9*c*, the insulating material housing 10, preferably the first housing part 13, can further have a rotation-prevention section 16 for the operating element 30, which rotation-prevention section is in engagement with or can be brought into engagement with the operating element 30 in the conductor clamping position, so that the operating element 30 is fixed in the conductor clamping position such that rotation is prevented. The rotation-prevention section 16 can be designed, for example, in the form of a latching projection which is formed in the insulating material housing 10, preferably in the second housing part 13 and which can be brought into engagement with a latching cutout 33*a* which is formed in the operating element 30, preferably in the operating lever 33. In the conductor clamping position, the rotationally fixed (latching) connection between the rotation-prevention section 16 and the operating element 30 therefore prevents a rotational movement of the operating element 30 about its rotation axis up to a certain force, which acts on the operating element 30 or free end of the operating lever 33, in the direction of the rotational movement. The force is preferably dimensioned in such a way that a fitter can overcome said force without problems using finger force.

The present invention is not restricted to the above-described exemplary embodiments provided that it is covered by the subject matter of the claims that follow. In particular, the features of the illustrated exemplary embodiments can be exchanged for one another and combined with one another in any desired manner.

The invention claimed is:

1. A terminal connector (1) for electrically connecting at least one conductor, comprising:

an insulating material housing (10), a contact body (20), which is accommodated in the insulating material housing (10), comprising:

a contact frame (21), and a contact spring (22) with a clamping limb (22*a*) for providing a conductor clamping point for electrically connecting the conductor together with the contact frame (21), wherein the clamping limb (22*a*) of the contact spring (21) can be moved between a conductor clamping position and a conductor release position, and an operating element (30) in order to move the clamping limb (22*a*) between the conductor clamping position and the conductor release position, wherein the operating element (30) has:

a bearing region (31) for rotatably mounting the operating element (30) in the insulating material housing (10) about a rotation axis, and at least one operating structure (32), which is at a radial distance from the bearing region (31) and extends in the direction of the rotation axis, for moving the clamping limb (22*a*) between the conductor clamping position and the conductor release position in the event of a rotational movement of the operating element (30) about its rotation axis, wherein the insulating material housing (10) has a supporting region (S) which axially extends between the rotation axis and the operating structure (32) in such a way that the operating structure (32) is supported on the supporting region (S) at least in the conductor release position.

2. The terminal connector (1) according to claim 1, wherein the operating structure (32) is supported on the supporting region (S) in the conductor release position in such a way that the operating element (30) is captively held in the conductor release position.

3. The terminal connector (1) according to claim 1, wherein the operating structure (32) is formed in such a way and the supporting region (S) extends between the rotation axis and the operating structure (32) in such a way that the operating structure (32) is supported on the supporting region (S) and preferably engages behind the supporting region (S) in the conductor clamping position, so that the operating element (30) is captively held in the conductor clamping position.

4. The terminal connector (1) according to claim 1, wherein the operating structure (32) is formed in such a way that the operating structure (32) inhibits a rotational movement of the operating element (30) in the conductor release position by contact with the clamping limb (22*a*), wherein the rotational movement is at least one rotational movement for moving the clamping limb (22*a*) from the conductor clamping position to the conductor release position.

5. The terminal connector (1) according to claim 1, wherein the operating structure (32) has a side (32*a*) which is directed toward the bearing region (31), wherein a first part (32*a*1) of the side (32*a*), which part is preferably in the form of a segment of a circle, is at a constant radial distance from the bearing region (31), and wherein a second part (32*a*2) of the side (32*a*), which second part adjoins the first part (32*a*1), is at an increasing radial distance from the bearing region (31).

6. The terminal connector (1) according to claim 5, wherein the first part (32*a*1) is supported on the supporting region (S) both in the conductor clamping position and also in the conductor release position, and wherein the second part (32*a*2) is preferably at a distance from the supporting region (S) both in the conductor clamping position and also in the conductor release position.

7. The terminal connector (1) according to claim 5, wherein the first part (32*a*1) is provided at an angle $\alpha$ in the range of from 15° to 40°, preferably of from 20° to 35°, particularly preferably of from 22° to 26°, with respect to the rotation axis, and/or wherein the second part (32*a*2) is provided at an angle $\beta$ of from 20° to 40°, preferably of from 25° to 40°, particularly preferably of from 30° to 35°, with respect to the rotation axis.

8. The terminal connector (1) according to claim 1, wherein the operating element (30) has an operating lever (33), wherein the operating structure (32) and the operating lever (33) are provided on substantially opposite sides with respect to the rotation axis and/or the bearing region (31).

9. The terminal connector (1) according to claim 1, wherein the operating element (30) has a guide section (34) which projects radially toward the rotation axis and which is accommodated in a sliding manner in a radial guide groove (17) of the insulating material housing (10), which radial guide groove runs at least partially around the rotation axis, preferably in a bearing region (11) of the insulating material housing (10), which bearing region interacts with the bearing region (31) for rotatably mounting the operating element (30), in order to axially guide the operating lever (30) on both sides in the event of the rotational movement of said operating lever about the rotation axis.

10. The terminal connector (1) according to claim 8, wherein the guide section (34) extends away from the operating lever (33), preferably from the center of the operating lever (33) with respect to the axial direction of the rotation axis.

11. The terminal connector (1) according to claim 1, wherein the operating element (30) has two operating structures (32, 32'), wherein the operating structures (32, 32') are at an axial distance from one another and preferably extend toward one another.

12. The terminal connector (1) according to claim 1, wherein a supporting face (S1) of the supporting region (S), on which the operating structure (32) is supported, is at a constant radial distance from the rotation axis, and is preferably designed in the form of a segment of a circle, particularly preferably in a manner corresponding to the first part (32*a*1) of the operating structure (32), as seen in the axial direction.

13. The terminal connector (1) according to claim 1, wherein the supporting region (S) is part of a guide groove (12), which is formed in the insulating material housing (10), for guiding the operating structure (32).

14. The terminal connector (1) according to claim 1, wherein the insulating material housing (10) has a first housing part (13) and a second housing part (14) which is connected to the first housing part (13), wherein the first housing part (13) is provided for rotatably mounting the operating element (30) and has the supporting section (S), and wherein the contact body (20) is accommodated between the first housing part (13) and the second housing part (14).

15. The terminal connector (1) according to claim 1, wherein the insulating material housing (10) has a rotation-prevention section (16) for the operating element (30), which rotation-prevention section is in engagement with the operating element (30) in the conductor clamping position, so that the operating element (30) is fixed in the conductor clamping position such that rotation is prevented.

16. The terminal connector (1) according to claim 1, wherein the contact frame (21) has a conductor insertion opening (21*a*) which is preferably situated behind the conductor clamping point in the conductor insertion direction (L).

17. The terminal connector (1) according to claim 1, wherein the clamping spring (22) has a supporting limb (22*b*) with which the clamping spring (22) is held and supported on the contact.

18. The terminal connector (1) according to claim 1, wherein the clamping limb (22*a*) is pretensioned against the contact frame (21) into the conductor clamping point, preferably by means of a preferably arcuate connecting limb (22*d*) which connects the clamping limb (22*a*) to the supporting limb (22*b*).

19. The terminal connector (1) according to claim 1, wherein the clamping limb (22*a*) has a region (22*a*1) for making contact with the operating element (30), which region is preferably provided between the region (22*c*) which connects the limbs (22*a*, 22*b*) and a further part (22*a*2) of the clamping limb (22*a*), which further part has the free end of the clamping limb (22*a*), wherein this region (22*a*1) extends laterally, preferably on either side of the further part (22*a*2) and preferably in the conductor insertion direction, preferably in the form of elongated lugs (22*a*3).

20. The terminal connector (1) according to claim 16, wherein the contact frame (21) and the contact spring (22) are provided and formed in relation to one another in such a way that the free end of the clamping limb (22*a*) does not enter the conductor insertion opening (21*a*) when said clamping limb (22*a*) moves between the conductor clamping position and the conductor release position.

21. The terminal connector (1) according to claim 1, wherein the insulating material housing (10) has a conductor insertion channel (K) which extends toward the conductor clamping point.

22. The terminal connector (1) according to claim 21, wherein the clamping limb (22*a*) extends transversely through the conductor insertion channel (K) and toward the conductor clamping point substantially in the conductor insertion direction (L) in an inclined manner.

23. A terminal arrangement (100) comprising at least two terminal connectors (1) according to claim 1, wherein the contact frames (21) are integrally formed with one another.

24. The terminal arrangement according to claim 23, wherein the conductor clamping points and associated operating elements (30) are arranged next to one another in a row, preferably with parallel or coaxially oriented rotation axes, wherein a web (18) preferably extends between in each case two adjacent operating elements (30) in order to preferably axially space apart the operating elements (30) from one another.

* * * * *